US007850533B2

(12) United States Patent
Osterman et al.

(10) Patent No.: US 7,850,533 B2
(45) Date of Patent: Dec. 14, 2010

(54) FLAME BARRIER, APPARATUS AND METHOD FOR ENTERTAINING GUESTS

(75) Inventors: Ross Osterman, Winter Park, FL (US); Steven C. Blum, Orlando, FL (US); Justin Michael Schwartz, Orlando, FL (US)

(73) Assignee: Universal City Studios LLLP, Universal City, CA (US)

( * ) Notice: Subject to any disclaimer, the term of this patent is extended or adjusted under 35 U.S.C. 154(b) by 1016 days.

(21) Appl. No.: 11/612,789

(22) Filed: Dec. 19, 2006

(65) Prior Publication Data

US 2008/0146358 A1 Jun. 19, 2008

(51) Int. Cl.
*A63J 5/02* (2006.01)
*A63J 5/00* (2006.01)

(52) U.S. Cl. ..... 472/65; 472/66; 472/75

(58) Field of Classification Search ..... 472/43–47, 472/59, 60, 65, 66; 40/427, 428
See application file for complete search history.

(56) References Cited

U.S. PATENT DOCUMENTS 4,009,954 A 3/1977 Ritzerfeld
4,485,601 A 12/1984 De Boel
4,683,868 A 8/1987 Ferguson et al.
5,756,920 A 5/1998 Fleming
5,989,128 A 11/1999 Baker et al.
6,254,489 B1 * 7/2001 Drobnis et al. ..... 472/65
6,602,938 B1 8/2003 Iji et al.
6,685,574 B2 2/2004 Hall
6,953,401 B2 10/2005 Starr

FOREIGN PATENT DOCUMENTS

DE 4437312 A1 5/1996
GB 2289496 A 11/1995

OTHER PUBLICATIONS

The Dictionary of Scientific and Technical Terms, Fifth Edition, McGraw-Hill, Inc., 1994, p. 766, Definition of "flame".
Product Sheet: Universal Fire-Shield Fire Kote 100, Fire Poly & ZB; Copyright 1990 Universal Fire Shield; Rev. Jun. 22, 2006.
Hy-Tech Flame Resist Flame Retardant Coating; Hy-Tech Thermal Solutions, LLC; www.hytechsales.com; Rev. Mar. 15, 2003.

* cited by examiner

*Primary Examiner*—Kien T Nguyen
(74) *Attorney, Agent, or Firm*—GE Global Patent Operation

(57) ABSTRACT

An apparatus for entertaining multiple guests includes a device that selectively generates a flame and a barrier interposed between each guest and the flame. The barrier is configured to remain transparent throughout multiple repetitions of use of the device for generating a flame. A method of entertaining guests is also presented.

39 Claims, 5 Drawing Sheets

FLAME BARRIER, APPARATUS AND METHOD FOR ENTERTAINING GUESTS

BACKGROUND OF THE INVENTION

1. Field of the Invention

The subject matter described herein relates generally to barriers for thermal energy and products of combustion and to apparatus and methods employing such a barrier for entertaining guests.

2. Related Art

To provide high entertainment value for today's sophisticated customer, themed entertainment venues, such as theme parks and amusement parks, include a variety of entertainment that is expected to thrill a guest. In one example, the entertainment involves action associated with a ride itself such as the effect of gravitational forces on the body that arises during high speed twists, turns, ups and downs of a roller coaster. In another example, the entertainment involves the surprise and apprehension created during a perceived event. For example, the Mummy attraction at Universal Studios Florida provides, among other special effects, several fire effects that are passed by guests during a ride through the attraction. The guests are located 20 to 30 feet from the flaming prop that is lit to provide the effect of radiating heat and a flash of light. At this distance, the sense of surprise and apprehension created by the effect is limited. Currently, when guests are directed close to an effect, within arms length, a simulated flame such as a flapping fabric, lighting effects, faux fire, fog and projection are typically used instead of a real flame. Furthermore, the path at which a flame burst follows is never directed toward a guest at close distances, thus limiting the guest's real sense of danger.

Accordingly, it is desired to increase the effect of surprise and apprehension associated with a flaming prop in order to provide the high entertainment value demanded by a sophisticated customer or guest.

BRIEF DESCRIPTION OF THE INVENTION

In accordance with an embodiment of the present invention, an apparatus for entertaining multiple guests comprises a device that selectively generates a flame and a barrier interposed between each guest and the flame. The barrier is configured to remain transparent throughout multiple repetitions of use of the device for generating a flame.

In accordance with another aspect of the invention, a barrier is configured to remain transparent after multiple blasts of a flame from a device for generating a flame wherein the flame is blasted proximal to the barrier. The barrier comprises a transparent sheet comprising at least one of glass and plastic and means for removing soot from the transparent sheet created by the multiple blasts of the flame.

In accordance with a further aspect of the invention, a method of entertaining at least one guest comprises directing at least one guest to a location; orienting the at least one guest in a particular direction; generating a flame that extends toward the location; and interposing a barrier between the at least one guest and the flame to prevent injury to the at least one guest while entertaining the at least one guest.

BRIEF DESCRIPTION OF THE DRAWINGS

The following detailed description is made with reference to the accompanying drawings, in which.

DETAILED DESCRIPTION OF THE PREFERRED EMBODIMENTS

An embodiment of the present invention concerns a barrier and a device for generating a flame and another involves a method of entertaining guests using the barrier and the device for generating a flame that provides a sophisticated guest with an increased effect of surprise and apprehension. In particular embodiments, the barrier may comprise a material that is configured to withstand repeated blasts of the flame and to remain transparent during each blast.

Throughout the present disclosure, it is intended that the term "flame" be given the broadest reasonable interpretation including a simulated flame or a genuine flame, the latter of which falling under a definition, e.g., found in *The Dictionary of Scientific and Technical Terms*, Fifth Edition, McGraw-Hill, Inc., 1994, Page 766 of a hot luminous reaction front (or wave) in a gaseous medium into which reactants flow and out of which products flow.

Figure 1:
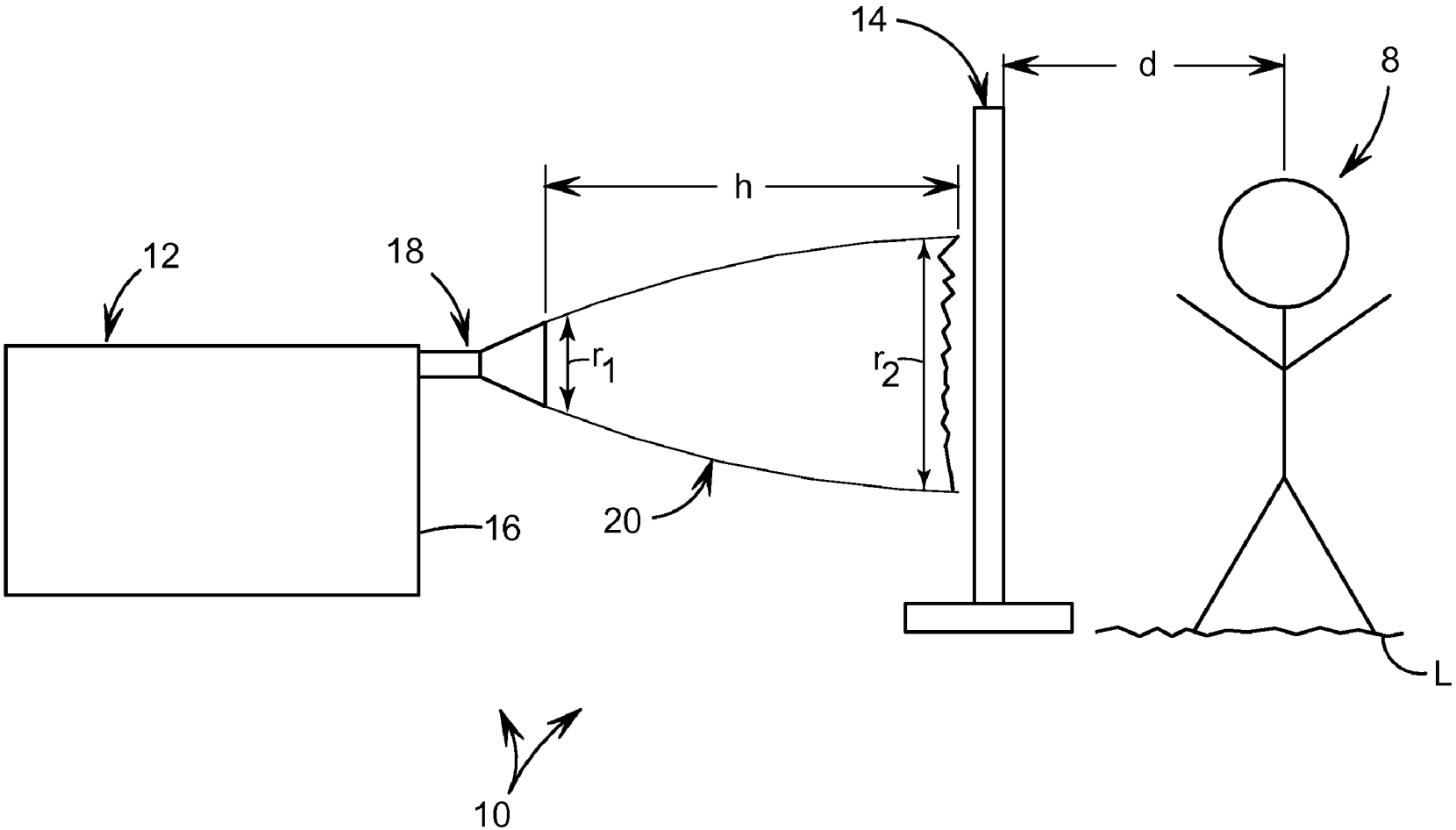
FIG. 1 is a diagram showing, from a side view, a barrier and a device for generating a flame located on one side of a barrier in accordance with one embodiment of the present invention and a guest to be entertained located on another side of the barrier.

Referring now to FIG. 1, an apparatus for entertaining a guest 8 in accordance with one embodiment of the present invention is illustrated generally at 10. In this embodiment, the apparatus 10 comprises a device for generating a flame 12 and a barrier 14.

In the illustrated embodiment, the device for generating a flame 12 comprises a body 16 and a nozzle 18. The internal workings within the body 16 are known and thus are not described herein, except to say that each combine to function to generate, through combustion or other means, a flame 20 that may be directed by the nozzle 18. Although not shown as such, it is contemplated in the present invention that the nozzle 18 may be adjustable to direct the flame in any particular direction. Also, the nozzle may be adjustable to vary the volume of the flame and/or provide a differing geometry of the flame such as a rectangular cross-sectional configuration or flat flame shape.

It has been found that in one aspect of the invention, a volume of the flame 20 that is greater than about 0.26 $m^3$ is sufficiently large to increase an effect of surprise and apprehension in a guest 8. In the illustrated embodiment, a rough approximation of a volume (V) of the flame 20 may be determined using an appropriate volumetric formula for a frustoconical section using a height dimension h, and radii, $r_1$ and $r_2$ as provided below:

$$V=\pi(r_2^2+r_1r_2+r_1^2)h/3. \quad \text{i.}$$

It will be appreciated that the volume is roughly approximated simply because it is a flame that may be flowing and therefore inherently has a somewhat amorphous volume. For example, a flame may be in the configuration of a traveling vortex ring. Accordingly, it will be appreciated, that important features of the flame are a perceived size, including for example, the angle from a guest's point of view and/or perspective cues from the environment, and a perceived proximity.

Figure 2:
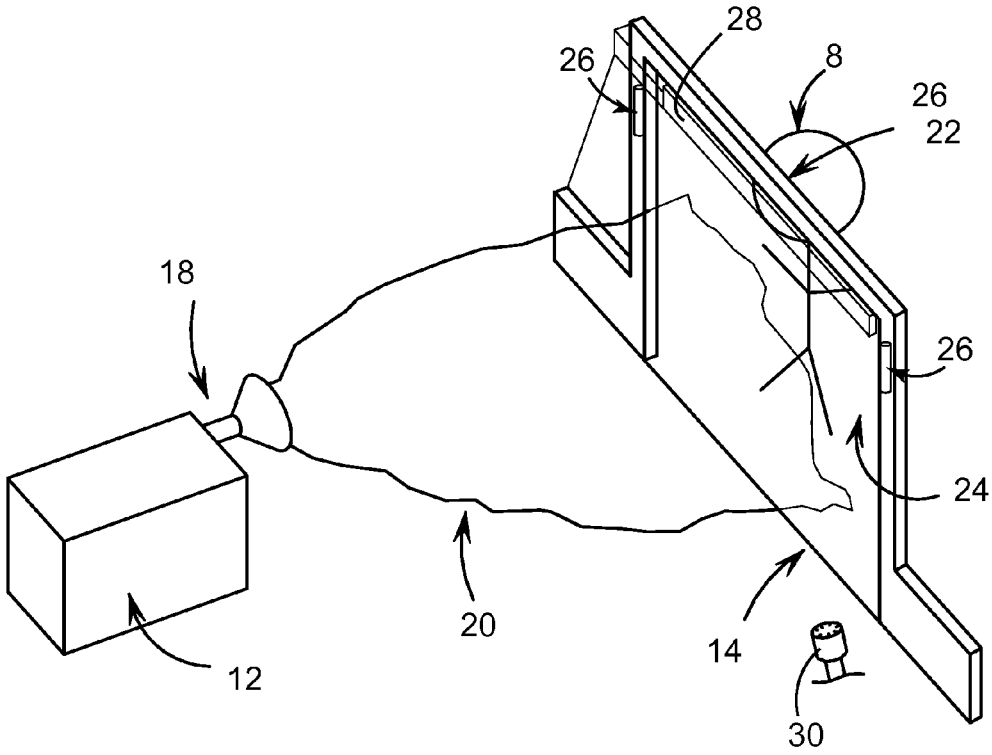
FIG. 2 is another diagram showing a perspective view of the embodiment of FIG. 1.

Referring now to FIG. 2, one embodiment of the barrier 14 comprises a frame 22 and a layer or sheet of material 24. It will be appreciated that in other embodiments of the present invention, the barrier 14 may comprise a fluid such as water, for example, a waterfall (not shown) or air, for example, a flow of high velocity air (also not shown) and combinations thereof.

The frame 22 may comprise a suitably strong and a flame resistant material such as steel and may function to support and strengthen the barrier 14 while allowing for an appropriate amount of expansion of the material 24.

The material 24 may comprise any suitable material that is transparent and is capable of withstanding the thermal pulse of the flame blast 20 and quasi steady state temperature of the barrier 14 which may result from repeated blasts of the flame 20. Where the flame 20 is generated by combustion, suitable materials include glass-ceramics, borosilicate glass and plastics with a high melting temperature. Suitable glass-ceramics include those sold under the trademark "FIRELIGHT" by the TGP company (www.fireglass.com), "PYRAN" by the Schoft company (www.us.schott.com) and "SUPERLITE", by the Safti company (www.safti.com). Suitable borosilicate glass includes that sold under the trademark "BOROFLOAT" by the Schoft company. Suitable high temperature plastics may include high temperature polycarbonate such as that sold by the General Electric Company (www.GE.com) under the trademarks "GEPAX", "LEXAN" and "VEROLITE" and that sold by the Bayer company (www.bayer.com) under the trademark "MAKROLON." The high temperature plastics may each also include a blend having a fire retardant additive such as a silicone compound. It will be understood that in certain applications it will be appreciated that the material of the barrier 14 may not need to be a high temperature material. It will be appreciated that this depends upon the magnitude of the blast of a flame, frequency, and known or ascertained heat transfer properties.

Figure 5:
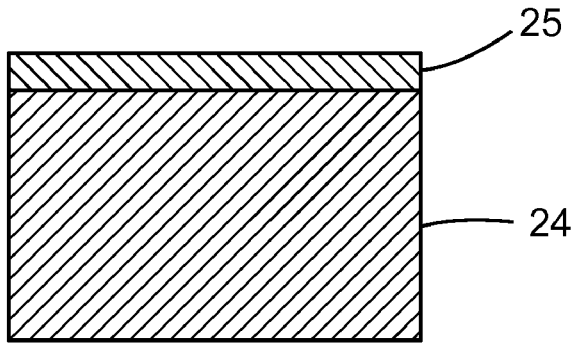
FIG. 5 is a partial sectional view of the barrier of FIG. 1, showing a substrate and a coating.

As illustrated in FIG. 5, the material 24 may comprise a coating 25 that functions to provide a thermal barrier to increase the fire resistant properties of the flame barrier. Example coatings are those sold under the trademarks "Fire Kote 100" by the Universal Fire Shield company and "Hy-Tech Flame Resist" by the Hy-Tech Company. These coatings may comprise an aqueous based resin liquid coating. Furthermore, this coating may also be configured, through the addition of a suspended conductive material such as copper (CU), aluminum (AL), silver (AG) or gold (Au), to carry an electrostatic charge as described below.

In order to prevent the build up of particulate matter, such as soot, on the material 24, various particular embodiments may be employed in accordance with the present invention. For example, a pair of electrodes 26 may be mounted to the frame 22 in order to provide an electrostatic charge to the coating on the material 24. For preventing the build up of soot, or in other words repelling soot from building up on the material 24, it will be appreciated that this charge may be generally the same as the natural charge of soot or the flame may include a component material having a particular charge or the soot may be given a charge during the combustion or transport process. Other particular embodiments include cleaning of the barrier 14 between blasts or a number of times throughout a day such as by use of a mechanical squeegee 28 that wipes the soot away wherein either the squeegee moves or the barrier moves, an air blast or water spray (either from a head 30) that is optionally along with a squeegee and through mechanical vibration of the barrier.

Figure 6:
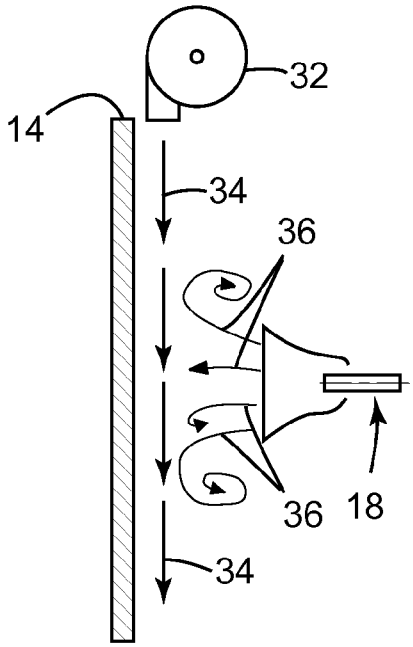
FIG. 6 is a diagram showing another embodiment of fluid blast system in accordance with the present invention.

One embodiment of a fluid blast system for removing soot or preventing the buildup of soot on a barrier is shown in FIG. 6. As shown, a blower 32 is located to provide a fluid output, such as pressurized air, represented by arrows 34, that flows in a direction that is parallel to a longitudinal axis of the barrier 14. Such an arrangement may advantageously vary a flow pattern, represented by arrows 36, of a flame thereby reduce the build up and/or facilitate removal of soot.

Figure 7:
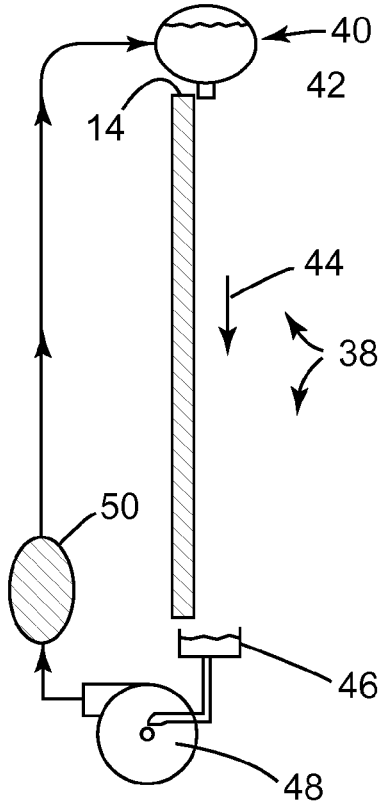
FIG. 7 is a diagram showing an embodiment of a liquid flow system in accordance with the present invention.

Referring now to FIG. 7, one embodiment of a liquid flow apparatus in accordance with the present invention for removing soot or preventing the buildup of soot on a barrier is shown generally at 38. The liquid flow apparatus 38 may comprise a container 40 that supports a volume of a liquid such as water and includes an output spout 42. The output spout 42 may be located on a flame directed side of the barrier 14 and configured to provide a generally laminar flow of liquid in the direction of arrow 44 via gravity. A collector 46 may collect the liquid and a pump 48 is provided for circulating the liquid through a filter 50 back to the container 40.

Referring again to FIG. 1 and in one particular embodiment, the barrier 14 may be transparent in the human visual range (wavelengths of 0.4-0.7 μ) while blocking other radiation wavelengths including IR radiation (about 1-12 μ). This is accomplished, e.g., by coating the barrier 14 with a material comprising a low emissivity and that is spectrally selective or by the bulk properties of the selected material. It will be appreciated that the foregoing allows a much larger flame effect much closer to the guests as the IR radiation from the free carbon is largely reflected by the visually transparent surface.

In another particular embodiment, the barrier 14 may be partially transparent in the IR, e.g., through use of a known coating that provides an incomplete IR blocking to convey a partial sense of intense heat to a guest. Such a coating is sold under the trademark "SUNCOAT" by Milgard Windows, Inc of Tacoma, Wash.

It will be appreciated that radiation from the heated barrier 14 itself may be incident on the guests, in order to counter act this, the barrier may be cooled between blasts to increase the likelihood of surprising a guest.

Referring also again to FIG. 1, in one particular embodiment and in order to best surprise the guest 8 and create a suitable amount of apprehension, it has been found that the distance d between the guest and the barrier 14 may be limited to approximately 3 feet. In operation and upon the guest 8 arriving at location L, the flame generating device 12 is energized and the flame 20 is created to surprise and entertain the guest.

Figure 3:
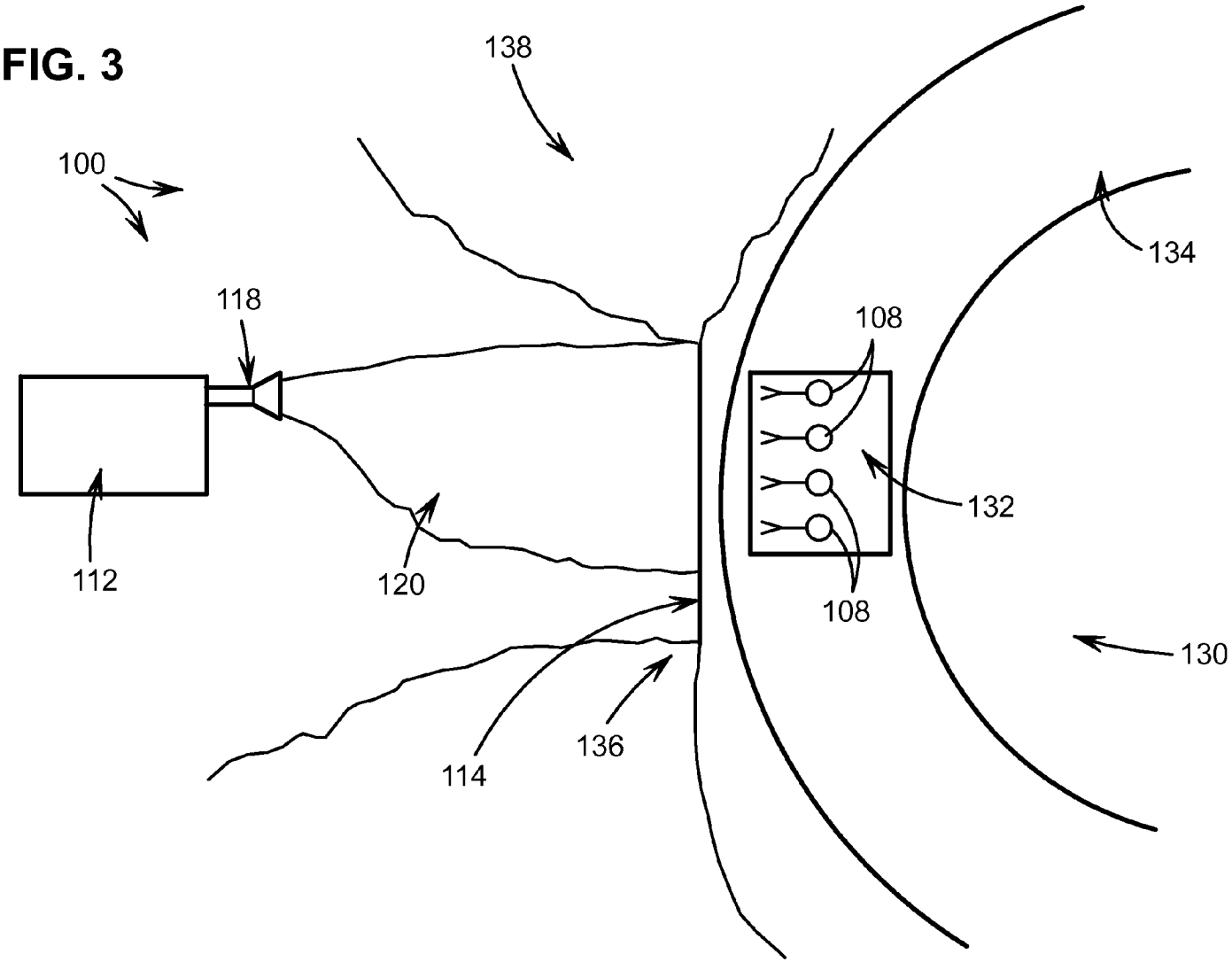
FIG. 3 is a diagram showing a barrier located between scenic elements and a device for generating a flame located on one side of a barrier and a path for a ride vehicle located on another side of the barrier in accordance with another embodiment of the present invention.

Another embodiment of the present invention is shown generally at 100 in FIG. 3. In FIG. 3, like components to those described above are not repeated hereafter and are labeled similarly to that in FIG. 2 excepting that each begins with one hundred. In this embodiment, rather than a single guest 8 (FIG. 2) being entertained by a flame 120, a ride system 132 is illustrated wherein multiple guests 108 are carried in a vehicle 132 that follows a track 134. Also, in this embodiment, scenery 136 and 138 are both provided to increase the likelihood of surprising the guests 108.

Figure 4:
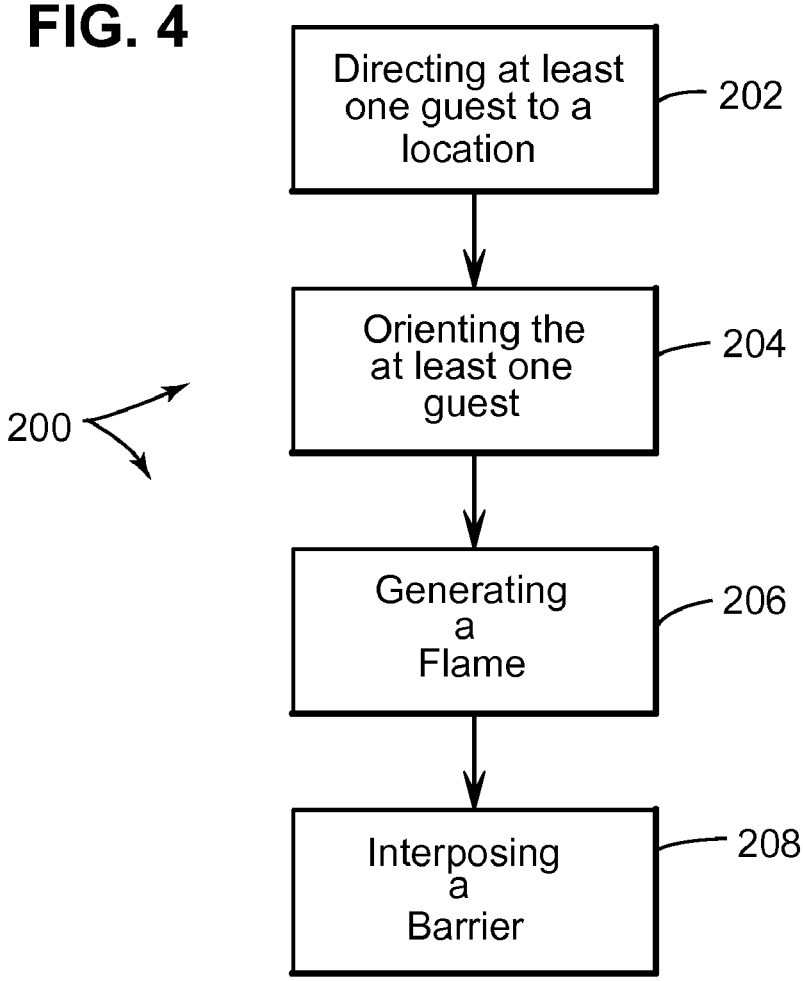
FIG. 4 is a sectional view of the barrier of FIG. 1, taken along line 1-1.

A further embodiment of the present invention is shown in FIG. 4, therein a method of entertaining at least one guest is shown generally at 200. In this embodiment and, as shown at 202, the method comprises directing at least one guest to a location; as shown at 204, orienting the at least one guest in a particular direction; as shown at 206, generating a flame that extends toward the location and in a direction that opposes the particular direction that the at least one guest is oriented; and, as shown at 208, interposing a barrier between the at least one guest and the flame to prevent injury to the at least one guest while entertaining the at least one guest. It will be appreciated that the steps of directing and orienting the at least one guest and generating a flame may be selectively repeatable and the method may further comprise configuring the barrier to remain transparent at least during the step of generating at least one flame and throughout each repetition thereof.

While the present invention has been described in connection with what are presently considered to be the most practical and preferred embodiments, it is to be understood that the present invention is not limited to these herein disclosed embodiments. Rather, the present invention is intended to cover all of the various modifications and equivalent arrangements included within the spirit and scope of the appended claims.

What is claimed is:

1. An apparatus for entertaining multiple guests, comprising:

a device that selectively generates a flame; and a barrier interposed between each guest and the flame and wherein the barrier is configured to remain transparent throughout multiple repetitions of use of the device for generating a flame;

wherein the barrier comprises a sheet comprising at least one of glass and plastic;

wherein the barrier further comprises a coating located on a surface of the sheet, the coating comprising a liquid resin.

2. The apparatus of claim 1, wherein the device that selectively generates a flame generates a flame that is configured to extend at least up to the barrier.

3. The apparatus of claim 2, wherein the flame has a volume of at least approximately 0.26 cubic meters.

4. The apparatus of claim 1, wherein the barrier is stationary.

5. The apparatus of claim 1, further comprising a vehicle for transporting multiple guests to a location adjacent the barrier.

6. The apparatus of claim 1, wherein the device that selectively generates a flame is configured to generate the flame via combustion.

7. The apparatus of claim 1, wherein the barrier is further configured to be transparent to wavelengths in the visual spectrum.

8. The apparatus of claim 1, wherein the barrier is further configured to be partially or completely transparent to wavelengths in the IR spectrum.

9. An apparatus for entertaining multiple guests, comprising:

a device that selectively generates a flame; and a barrier interposed between each guest and the flame and wherein the barrier is configured to remain transparent throughout multiple repetitions of use of the device for generating a flame;

wherein the barrier comprises a sheet comprising at least one of glass and plastic;

wherein the sheet further comprises an electrode mounted to a surface of the sheet located proximal to the device that selectively generates at least one flame and the electrode conducting an electrical charge to the surface.

10. The apparatus of claim 9, wherein the device that selectively generates a flame generates a flame that is configured to extend at least up to the barrier.

11. The apparatus of claim 10, wherein the flame has a volume of at least approximately 0.26 cubic meters.

12. The apparatus of claim 9, wherein the barrier is stationary.

13. The apparatus of claim 9, further comprising a vehicle for transporting multiple guests to a location adjacent the barrier.

14. The apparatus of claim 9, wherein the device that selectively generates a flame is configured to generate the flame via combustion.

15. The apparatus of claim 9, wherein the barrier is further configured to be transparent to wavelengths in the visual spectrum.

16. The apparatus of claim 9, wherein the barrier is further configured to be partially or completely transparent to wavelengths in the IR spectrum.

17. A method of entertaining at least one guest, comprising:

directing at least one guest to a location;

orienting the at least one guest in a particular direction;

generating a flame that extends toward the location and wherein generating a flame further comprises generating a flame in a direction that generally opposes the particular direction that the at least one guest is oriented; and interposing a barrier between the at least one guest and the flame to prevent injury to the at least one guest while entertaining the at least one guest;

wherein the steps of directing and orienting the at least one guest and generating a flame are selectively repeatable and further comprising configuring the barrier to remain transparent at least during the step of generating at least one flame and throughout each repetition thereof;

wherein configuring the barrier to remain transparent comprises using means for preventing the build up of soot on the barrier.

18. The method of claim 17, wherein the barrier comprises at least one of glass and plastic.

19. The method of claim 18, further comprising coating a surface of the barrier to retain transparency throughout each repetition of the step of generating a flame.

20. The method of claim 17, wherein the step of generating a flame comprises generating a flame that is in a line of sight of a guest.

21. The method of claim 17, wherein the means for preventing the build up of soot on the barrier comprises at least one of a squeegee, a fluid curtain and a flow of liquid.

22. The method of claim 17, wherein the step of generating at least one flame that extends toward the location comprises generating a flame that extends at least up to the barrier.

23. The method of claim 22, wherein the flame has a volume of at least 0.26 cubic meters.

24. The method of claim 17, wherein the barrier is disposed within 3 feet of the location to which the at least one guest is directed.

25. The method of claim 17, wherein the barrier is stationary.

26. The method of claim 17, wherein the at least one guest comprises multiple guests.

27. The method of claim 17, wherein the steps of directing and orienting the at least one guest comprises transporting multiple guests.

28. The method of claim 17, wherein the step of generating a flame is carried out through combustion.

29. A method of entertaining at least one guest, comprising:

directing at least one guest to a location;

orienting the at least one guest in a particular direction;

generating a flame that extends toward the location and wherein generating a flame further comprises generating a flame in a direction that generally opposes the particular direction that the at least one guest is oriented; and interposing a barrier between the at least one guest and the flame to prevent injury to the at least one guest while entertaining the at least one guest;

wherein directing and orienting the at least one guest and generating a flame are selectively repeatable and further comprising configuring the barrier to remain transparent at least during the step of generating at least one flame and throughout each repetition thereof;

wherein configuring the barrier to remain transparent comprises applying an electrical charge to the barrier.

30. The method of claim 29, wherein the barrier comprises at least one of glass and plastic.

31. The method of claim 30, further comprising coating a surface of the barrier to retain transparency throughout each repetition of the step of generating a flame.

32. The method of claim 29, wherein the step of generating a flame comprises generating a flame that is in a line of sight of a guest.

33. The method of claim 29, wherein the step of generating at least one flame that extends toward the location comprises generating a flame that extends at least up to the barrier.

34. The method of claim 33, wherein the flame has a volume of at least 0.26 cubic meters.

35. The method of claim 29, wherein the barrier is disposed within 3 feet of the location to which the at least one guest is directed.

36. The method of claim 29, wherein the barrier is stationary.

37. The method of claim 29, wherein the at least one guest comprises multiple guests.

38. The method of claim 29, wherein the steps of directing and orienting the at least one guest comprises transporting multiple guests.

39. The method of claim 29, wherein the step of generating a flame is carried out through combustion.

* * * * *